US005682947A

United States Patent [19]

McFarlane

[11] Patent Number: 5,682,947

[45] Date of Patent: Nov. 4, 1997

[54] HOUSING ASSEMBLY FOR A COIL HEAT EXCHANGER

[75] Inventor: D. Patrick McFarlane, Pavilion, N.Y.

[73] Assignee: Graham Corporation, Batavia, N.Y.

[21] Appl. No.: 646,006

[22] Filed: May 7, 1996

Related U.S. Application Data

[63] Continuation of Ser. No. 339,552, Nov. 15, 1994, abandoned.

[51] Int. Cl.[6] ..... F28D 7/04

[52] U.S. Cl. ..... 165/163; 105/74

[58] Field of Search ..... 165/163, 74

[56] References Cited

U.S. PATENT DOCUMENTS

| | | | |
|---|---|---|---|
| 2,129,300 | 9/1938 | Bichowsky . | |
| 2,341,319 | 2/1944 | Graham et al. . | |
| 2,523,990 | 9/1950 | Graham . | |
| 2,578,059 | 12/1951 | Graham . | |
| 2,736,533 | 2/1956 | Allen . | |
| 2,970,812 | 2/1961 | Kritzer . | |
| 3,006,612 | 10/1961 | Herbert . | |
| 3,499,484 | 3/1970 | Lanzoni . | |
| 3,522,840 | 8/1970 | Wentworth . | |
| 3,802,499 | 4/1974 | Garcea . | |
| 4,310,182 | 1/1982 | Vandenbossche . | |
| 4,669,533 | 6/1987 | Hebl | 165/163 X |
| 5,022,461 | 6/1991 | Potier et al. . | |
| 5,242,015 | 9/1993 | Saperstein et al. . | |

FOREIGN PATENT DOCUMENTS

| | | |
|---|---|---|
| 0150147 | 9/1936 | Austria . |
| 0529819 | 3/1993 | European Pat. Off. . |
| 1139614 | 11/1962 | Germany . |
| 8605578 | 9/1986 | WIPO . |

*Primary Examiner*—John Fax
*Attorney, Agent, or Firm*—Cumpston & Shaw

[57] ABSTRACT

A heat exchanger having a housing for retaining a coil bundle, wherein the housing includes a first and second movable end for contacting one housing end with one end of the coil bundle and the remaining housing end with the second end of the coil bundle. The housing includes a sliding seal between the movable ends to permit relative motion between the ends while maintaining a sealed relation therebetween. Each movable end includes an aperture and a corresponding fastener for engaging the adjacent portion of the coil bundle to draw the coiled bundle against the respective end, thereby permitting removal of one end of the housing upon removal of a single fastener.

17 Claims, 11 Drawing Sheets

HOUSING ASSEMBLY FOR A COIL HEAT EXCHANGER

This application is a continuation of application Ser. No. 08/339,552 filed on Nov. 15, 1994, now abandoned.

FIELD OF THE INVENTION

The present invention relates to heat exchangers, and more particularly, to a coil bundle heat exchanger for passing a first fluid through a coil assembly and passing a second fluid along a external spiral flow path defined by the space between adjacent tube coils and a housing.

BACKGROUND OF THE INVENTION

Coil tube exchangers are disclosed in U.S. Pat. Nos. 2,129,300, 2,523,990, 2,587,059, 2,736,533, 3,006,612, as well as 5,242,015. In operation, a first fluid enters a coil bundle through an inlet manifold. The first fluid passes through the coils to exit through an outlet manifold projecting through a base plate. A second fluid enters the housing through an inlet port and travels along an external spiral fluid path defined by the outside of the coil bundle and the housing. The fluid passes between radially spaced loops of the coils and exits the housing through an outlet port.

Optimal efficiency of the heat exchanger is achieved when the external flow path remains free from fouling and is maintained as a spiral flow path. That is, flow in the external fluid path which crosses the coils or passes between the ends of the housing and the coil bundle reduces the efficiency of the heat exchanger. Therefore, a sheet gasket or seal is often disposed at the desired points of contact between the housing and the coil bundle. Specifically, the sheet gasket is located between the base plate and the coil bundle as well as between the casing and the coil bundle. The gaskets accommodate manufacturing tolerances or variations in the casing, coil bundle and base plate.

However, gaskets have a tendency to degrade and permit misdirected flow. Further, if the fluid passing in the external flow path has fouling tendencies, the flow path may become restricted. Therefore, regular disassembly and cleaning of the heat exchanger and casing may be necessary. To disassemble the heat exchanger, the base plate must be unfastened from the casing, which requires the removal of a plurality of base plate nuts. The casing is then separated from the base plate. Manifold fasteners are then removed from the coil assembly to separate the base plate and the coil assembly. Upon cleaning of the constituent parts, the heat exchanger is reassembled, new gaskets installed, the manifold nuts replaced, and all the base plate nuts are engaged to bolt the housing halves to each other and seal the heat exchanger.

While the present coil bundle heat exchangers offer significant advantages over straight tube heat exchangers, the disassembly and assembly required for periodic cleaning and maintenance of the heat exchanger represents a significant investment in time and resources. In addition, the advantages of the coil bundle heat exchangers are not realized when the integrity of the external flow path is compromised.

Therefore, a need exists for a housing for a coil heat exchanger which is easily assembled and disassembled to permit maintenance of the heat exchanger. The further need exists for a coil bundle heat exchanger which increases the integrity of the external flow path defined between the coil assembly and the housing.

SUMMARY OF THE INVENTION

The present invention provides a coil bundle heat exchanger having a housing with reduced disassembly and assembly requirements, while improving the integrity of the external flow path defined by the coil assembly and the housing.

Generally, the present heat exchanger includes a housing for enclosing a coil bundle, wherein the housing has a first and second relatively movable ends, and a sliding seal between the first and second ends to permit the ends to be moved together to engage an upper and a lower surface of the coil bundle and prevent fluid flow therebetween.

Specifically, the invention includes a heat exchanger assembly for retaining a coil assembly, the coil assembly having a coil bundle partially defined by an upper surface and a spaced apart lower surface, the heat exchanger assembly including a housing for enclosing the coil bundle, the housing having first and second relatively movable ends, the first end including a first aperture therethrough and the second end including a second aperture therethrough, and a sliding seal between the first and second ends to permit the ends to be moved together to engage the upper and lower surfaces of the coil bundle; a first arm attached to the coil bundle and projecting from the upper surface, the first arm sized to pass through the first aperture; and a second arm attached to the coil bundle and projecting from the lower surface and sized to pass through the second aperture.

The present heat exchanger creates a positive compression interface between both the top and the bottom of the coil assembly and the respective adjacent end of the housing independent of the exact size of the coil assembly. That is, one end of the coil assembly may be drawn against one end of the housing and the remaining end of the coil assembly may be drawn against the remaining end of the housing to operably contact the housing ends wherein the coil assembly ends, and the housing ends are movable relative to each other in a sealed relation. The engagement of each end of the coil assembly to an end of the housing may be accomplished by a single fastener.

The interface between the housing ends, specifically, the casing and the base plate, includes a sliding seal which permits movement of the casing towards and away from the base plate while maintaining a sealing relation. Therefore, movement of the ends of the housing is permitted along the longitudinal axis of the coil assembly while maintaining the base plate and the casing in a sealed relation.

DETAILED DESCRIPTION OF THE PREFERRED EMBODIMENTS

Figure 1:
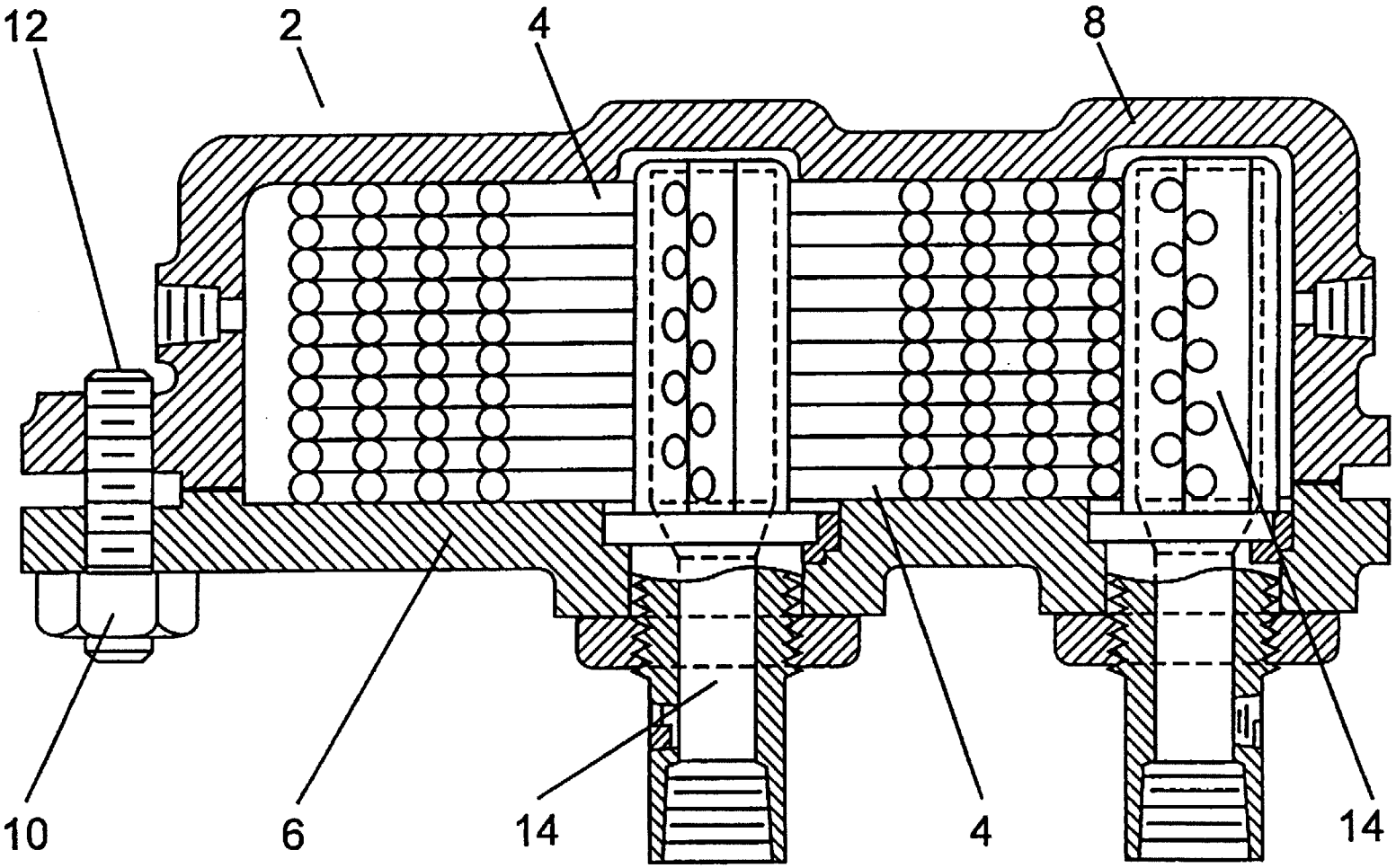
FIG. 1 (Prior Art)
FIG. 1 is a side elevational cross sectional view showing a coiled heat exchanger and housing of the prior art.
Figure 2:
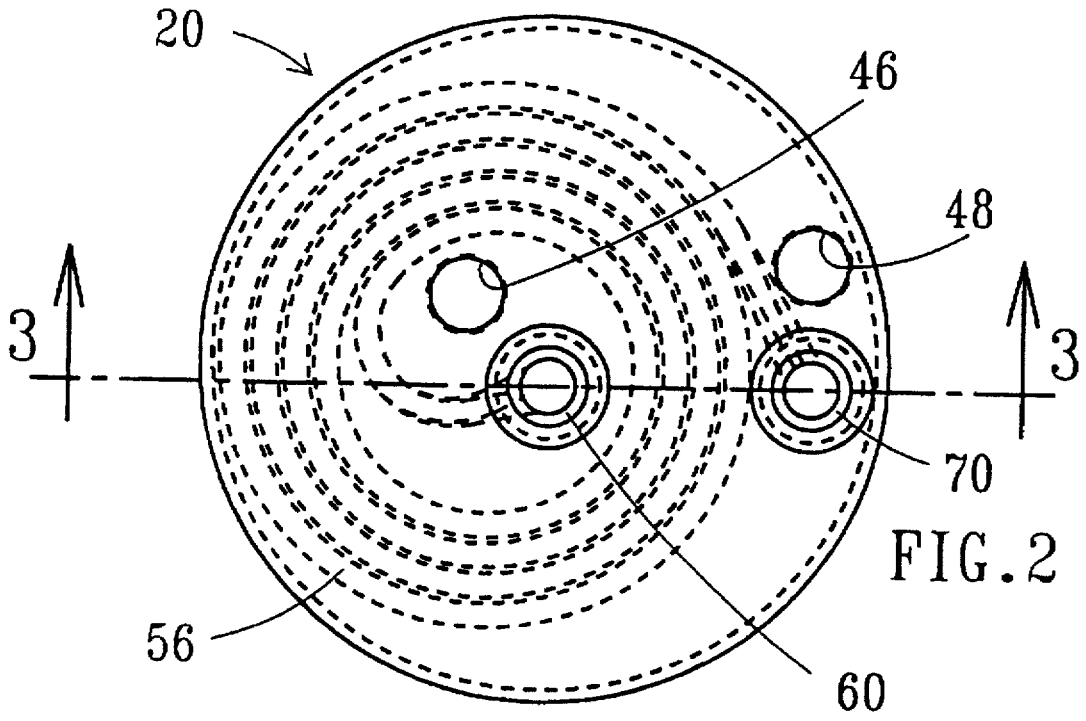
FIG. 2 is a top plan view of a housing according to the present invention.

Referring to FIG. 1, a coil bundle heat exchanger 2 of the prior art is shown. The coil bundle heat exchanger design is based upon a plurality of planar spiral coils 4 held together between two surfaces. One of the surfaces is a base plate 6 and the remaining surface is the end of a one piece shell or casing 8. Although not shown, a gasket may be placed between the base plate 6 and the casing 8. Base plate nuts 10 are engaged with casing studs 12 for bolting the base plate to the casing. Alternatively, the casing 8 and base plate 6 may be welded together. The base plate 6, casing 8 and tube bundle define a spiral shaped fluid path outside of the coil bundle. The inner and outer end of each coil is attached to a manifold 14 and the two manifolds project through and are fastened to the base plate 6.

As shown in FIGS. 2–11, the heat exchanger 20 of the present invention is disclosed. The present heat exchanger 20 includes a housing 22 for enclosing a coil-manifold assembly 50, wherein the housing includes a casing 28 and a base plate 26. Although the heat exchanger 20 is described in terms of a circular periphery, it is understood the cross section of the heat exchanger may be any of a variety of configurations such as obround, oval, rectangular or polygonal.

The casing 28 includes an end wall 30 and an extending side wall 32 to define a substantially cup shaped member. The end wall 30 defines an end of the heat exchanger housing 22 and is a planar member. In the first embodiment shown in FIGS. 2 and 3, the end wall 30 includes a casing aperture 31. Preferably, the casing aperture 31 is located at or adjacent to the center of the end wall 30. In addition, the end wall 30 includes a casing recess 29 to receive a portion of the manifold assembly 50. However, it is understood the casing aperture 31 may be offset from the center of the end wall 30. The end wall 30 and side wall 32 may be a single casting of metal or may be separately manufactured and bonded or welded together.

The side wall 32 extends from the end wall 30 to terminate at a free edge 34. In each of the embodiments shown, the free edge 34 defines a circular periphery. The inner surface of the side wall 32 includes a sealing surface 36 adjacent the free edge 34. The sealing surface 36 may be the inner surface of the side wall 32 and therefore extend to include the entire side wall. Alternatively, the sealing surface 36 may be machined into the side wall 32 to define a slightly larger periphery than the remaining portion of the side wall. Preferably, the side wall 32 is formed of a metal such as stainless steel which permits the entire side wall to function as the sealing surface 36. If the sealing surface 36 is machined into the side wall, the sealing surface extends approximately ¾ inch from the free edge 34.

Figure 3:
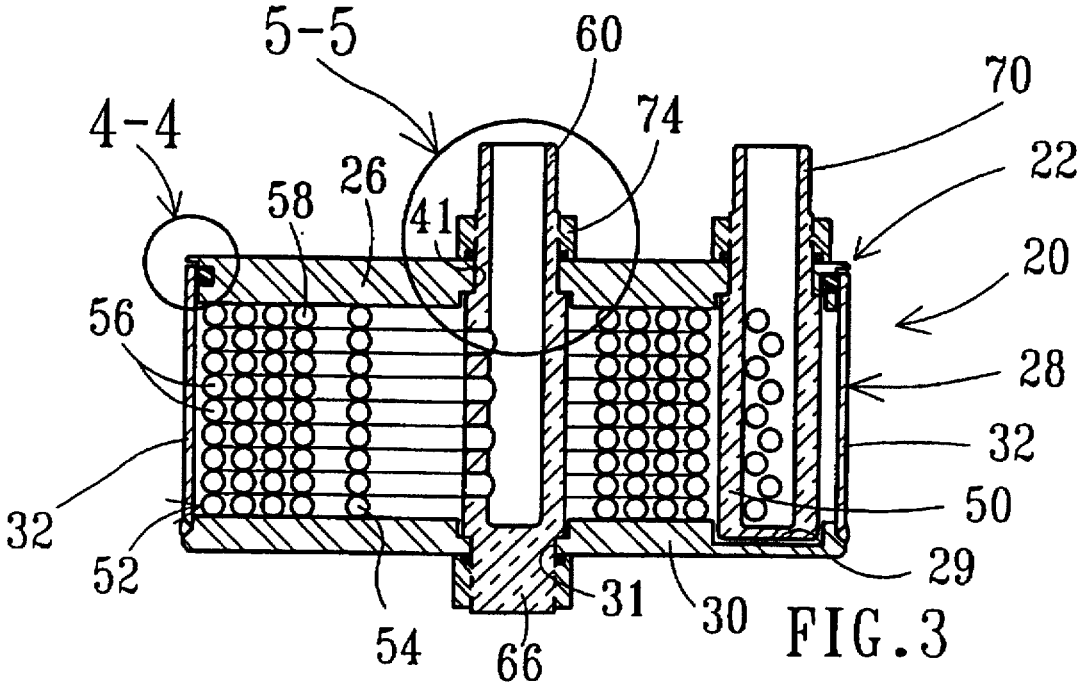
FIG. 3 is a side elevational cross sectional view taken along lines 3—3 of FIG. 2.
Figure 4:
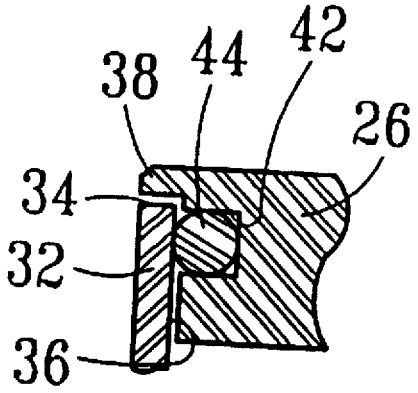
FIG. 4 is an enlarged view of the area circumscribed by line 4—4 of FIG. 3.
Figure 5:
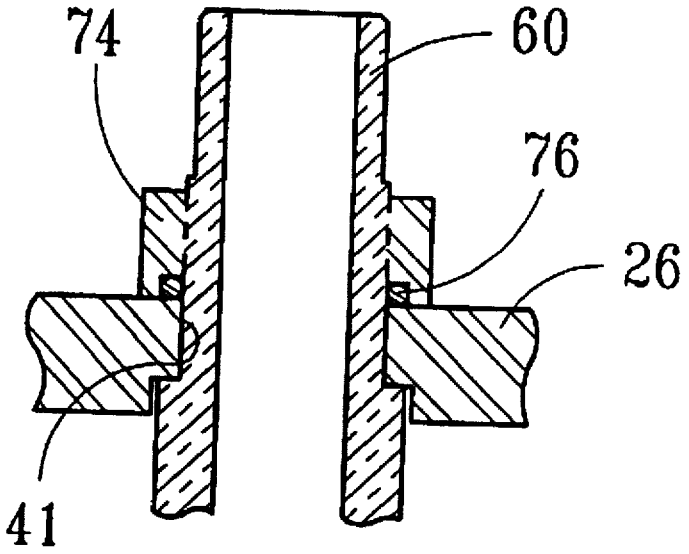
FIG. 5 is an enlarged view of the area circumscribed by line 5—5 in FIG. 3.
Figure 6:
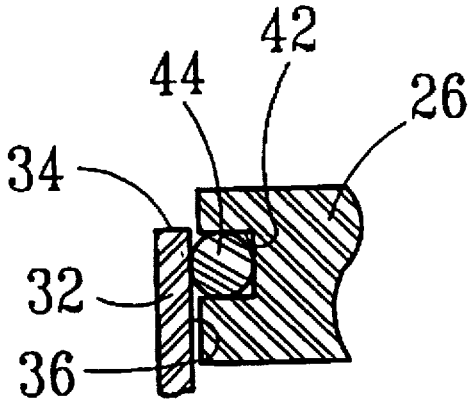
FIG. 6 is an alternative seal interface.
Figure 8:
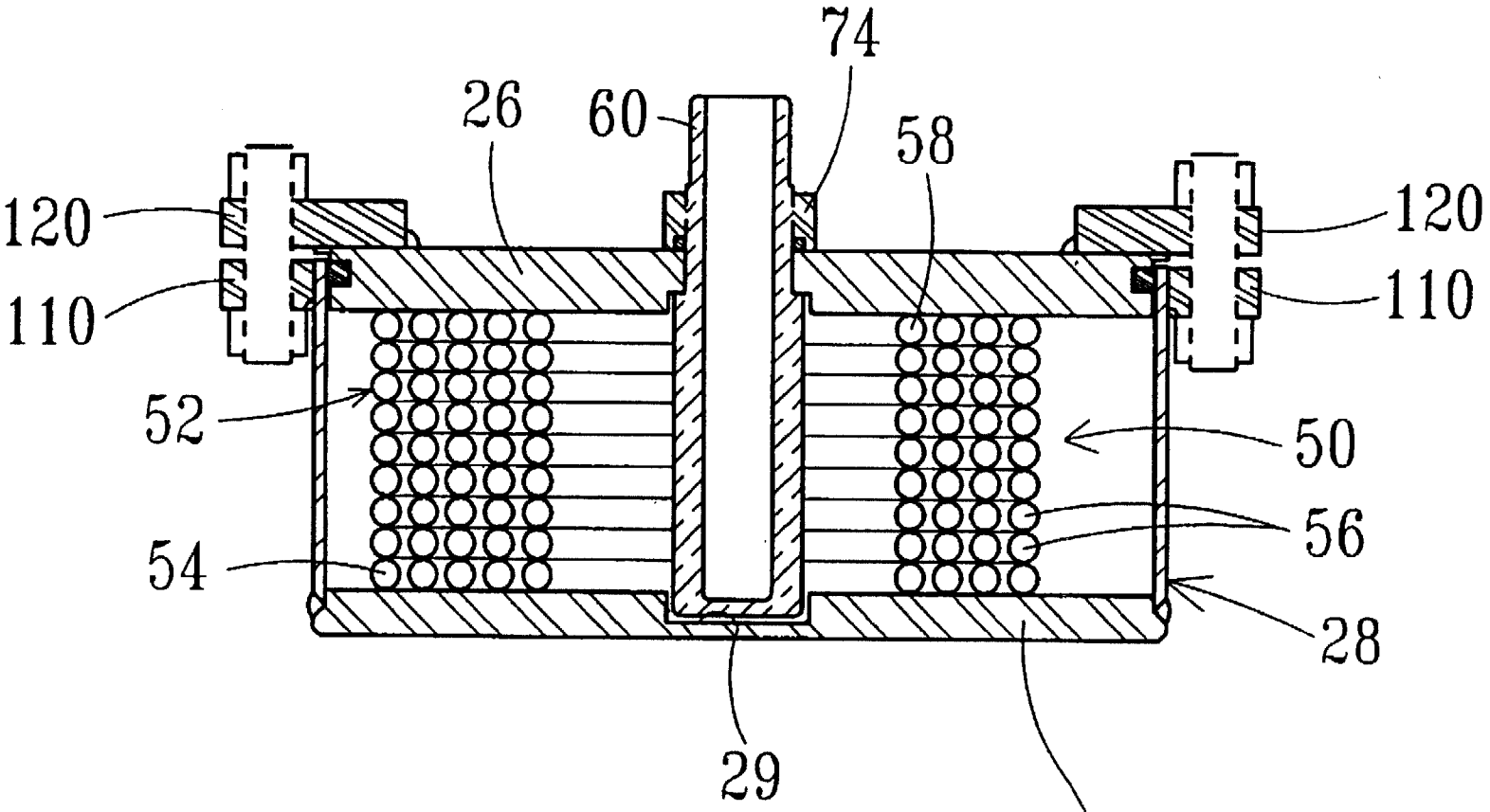
FIG. 8 is a cross sectional elevational view taken along lines 8—8 of FIG. 7.
Figure 10:
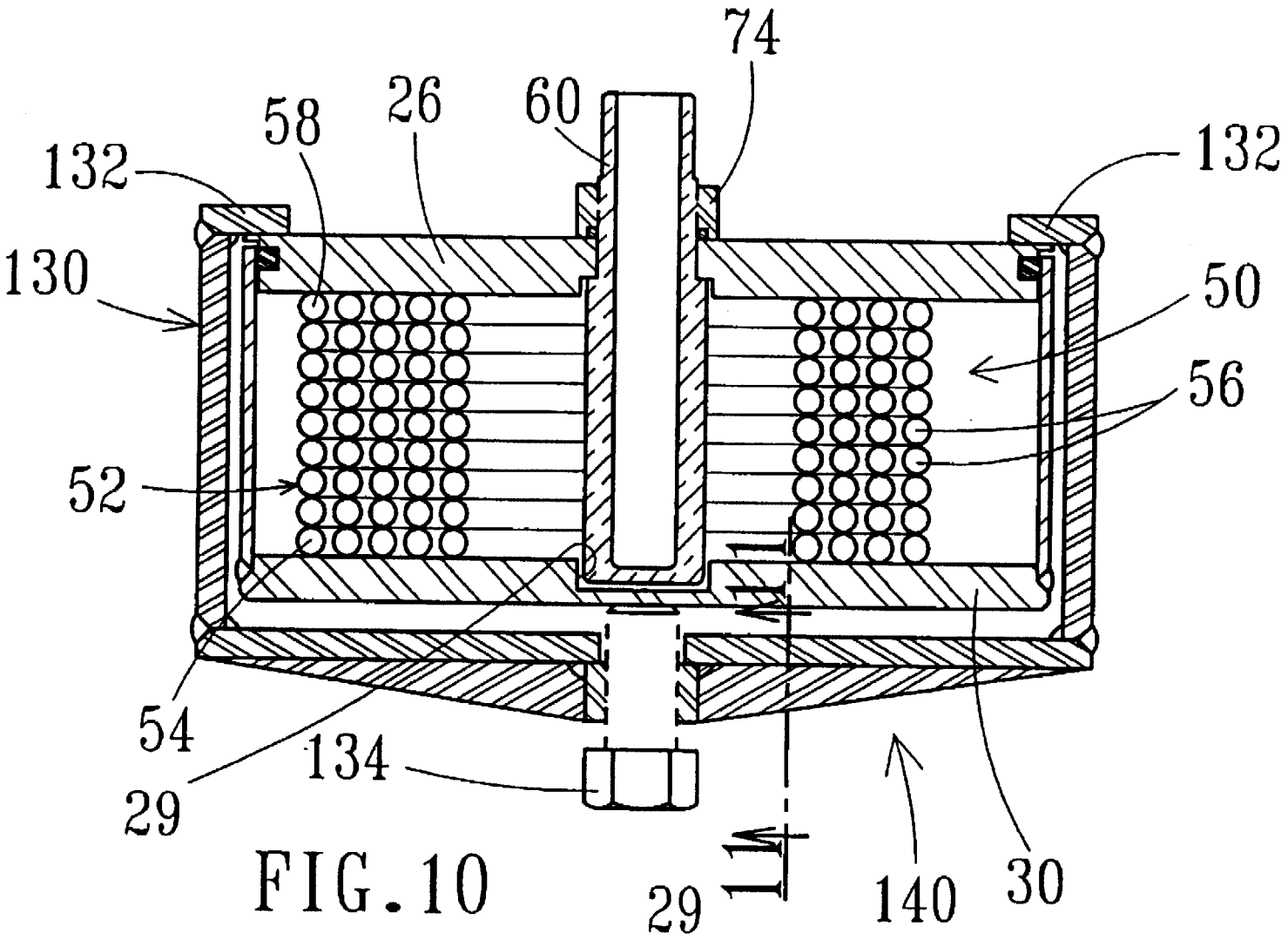
FIG. 10 is a cross sectional elevational view taken along lines 10—10 of FIG. 9.

The base plate 26 is a planar member sized to be at least partially received within the sealing surface 36. The periphery of the base plate 26 which is sized to be received within the sealing surface 36 includes an annular groove 42 into which a seal 44, such as an o-ring is disposed. As shown in FIGS. 4–6, the base plate 26 may include a protective lip 38 adjacent the groove 42. Alternatively, referring to FIG. 6, the base plate 26 may be formed without the protective lip 38. The base plate 26 defines an end of the heat exchanger housing 22 and includes a base plate aperture 41 as well as an inlet port 46 and an outlet port 48. Referring to FIG. 3, 8 and 10, one end of the housing 22 may be substantially cup shaped and sized to slidably receive the remaining end.

The coil-manifold assembly 50 includes a multi-layer spiral coil bundle 52 fluidly connected to a first manifold 60 and a second manifold 70, wherein the first manifold 60 is located at an inner end of the spiral and the second manifold 70 is located at an outer end of the coil. The first manifold 60 may be an inlet manifold and the second manifold 70 may be an outlet manifold. The coil bundle 52 is generally defined by a plurality of planar coils 56 which follow a common trace. Each coil 56 lies in a given plane and the coils are stacked to form a bundle which defines a spiral path between the loops of the coils. Therefore, the coil-manifold assembly 50 has a generally cylindrical configuration having a longitudinal axis perpendicular the parallel planes of the coils. The coil-manifold assembly 50 is peripherally defined by the outer periphery of the plurality of planar coils, one end or surface of the assembly is defined by a top coil 54 and the remaining end or surface is defined by a spaced apart bottom coil 58. It is understood that the coil bundle 52 may include only a single coil 56 or layer. That is, the coil-manifold assembly 50 may include only a single coil having an upper surface and a lower surface. As shown in FIGS. 3, 8 and 10, the top coil 54 is shown beneath the bottom coil 58. This is due to the general industry practice of assembling the heat exchanger with the base plate 26 beneath the end wall 30. In addition, it is understood the heat exchanger 20 may be operably employed in any orientation, so that top and bottom coil designations may be encompassed by a first and second spaced apart coils.

Referring to FIG. 3, one of the first and the second manifolds 60, 70 projects from one end of the coil-manifold assembly 50 through the plane of the bottom coil 58 and a portion of the remaining manifold projects from the remaining end of the coil-manifold assembly 50 through the plane of the top coil 54. Alternatively, both the first and the second manifold 60, 70 may fluidly extend from one end of the coil-manifold assembly 50, wherein at least one manifold or the coil-manifold assembly includes a connector or arm 66 extending beyond the plane of the opposing end of the coil-manifold assembly. In the first embodiment, at least one manifold 60, 70 includes a connector or arm 66 sized to be received through the casing aperture 31 or the base plate aperture 41. It is understood the arm 66 may be a part of the manifold, connected to the manifold or integral with the manifold. Preferably, the manifold nearest the center of the housing 22 includes the connector 66 so that the manifold extends through both ends of the housing. The fluid path in this extended manifold may pass through either or both the base plate 26 and the end wall 30.

The portion of the manifold 60, 70, connector or arm 66 extending beyond the plane of the coil layer at the end of the coil-manifold assembly 50 includes a plurality of threads for releasably engaging a threaded fastener.

Figure 7:
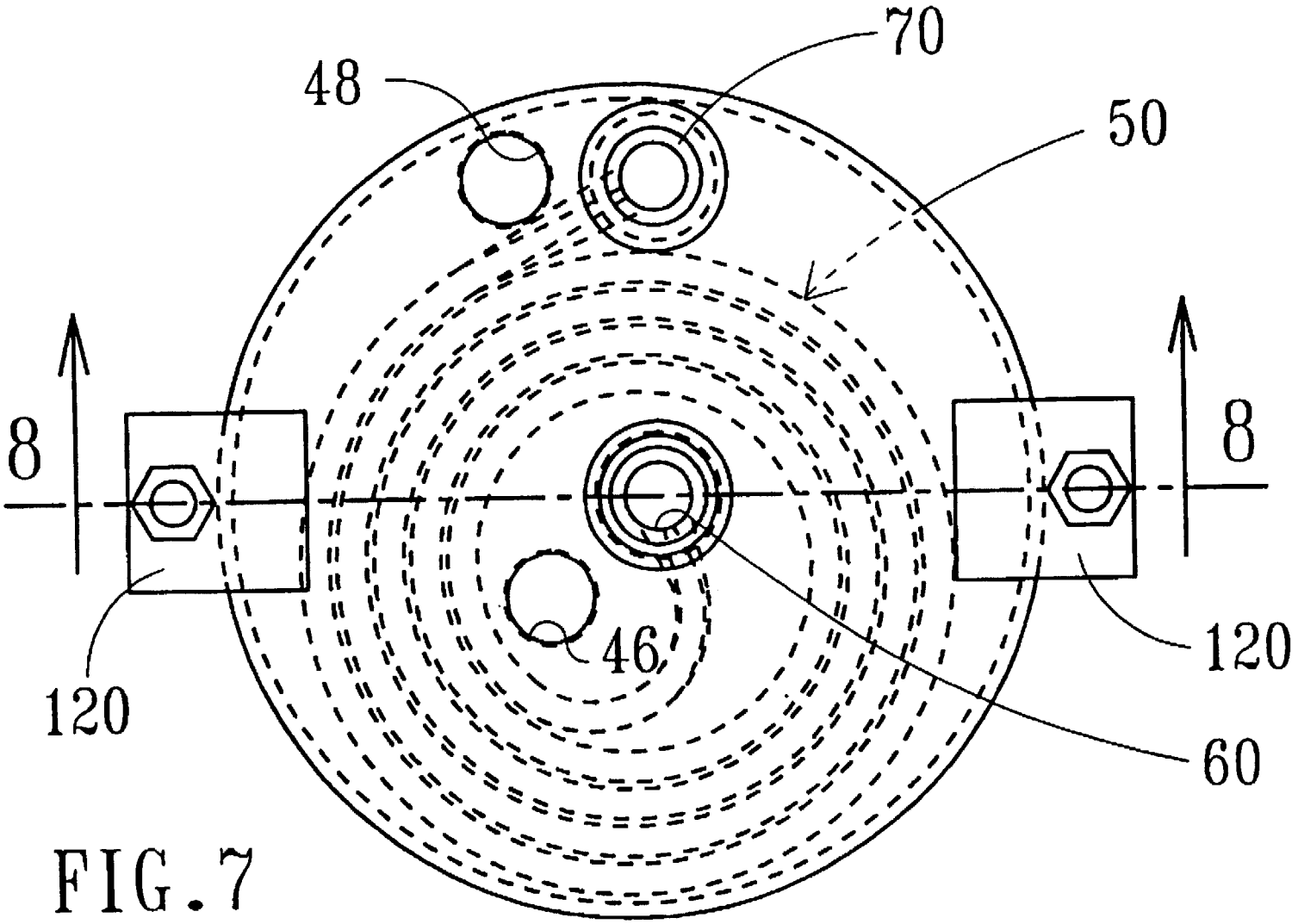
FIG. 7 is a top plan view of an alternate embodiment of the present invention.

FIGS. 7 and 8 illustrate an alternative construction of the heat exchanger 20 which provides movable ends of the housing 22 for contacting the respective ends of the coil manifold assembly 50. The common elements with the first embodiment are identified with the same reference numbers.

In this embodiment, the side wall 32 includes at least two projecting tabs 110 which extend beyond the periphery of the casing 28. Similarly, the base plate includes mating tabs 120 for cooperatively aligning the casing 28 and the base plate 26. Threaded fasteners, such as bolts are passed through the tabs 110 and mating tabs 120, and nuts are engaged to draw the end wall 30 towards the base plate 26.

As in the first embodiment, the sliding seal permits relative motion of the housing ends so that the distance between the ends is dictated by the coil manifold assembly 50 (specifically the upper and lower coils 54, 58) rather than the sizing of the housing 22. The protective lip 38 does not limit motion of the housing ends, but rather protects the seal 44. The casing 28 which includes end wall 30 is formed without a casing aperture 31, but may include a casing recess 29 to receive an end of a manifold.

Figure 9:
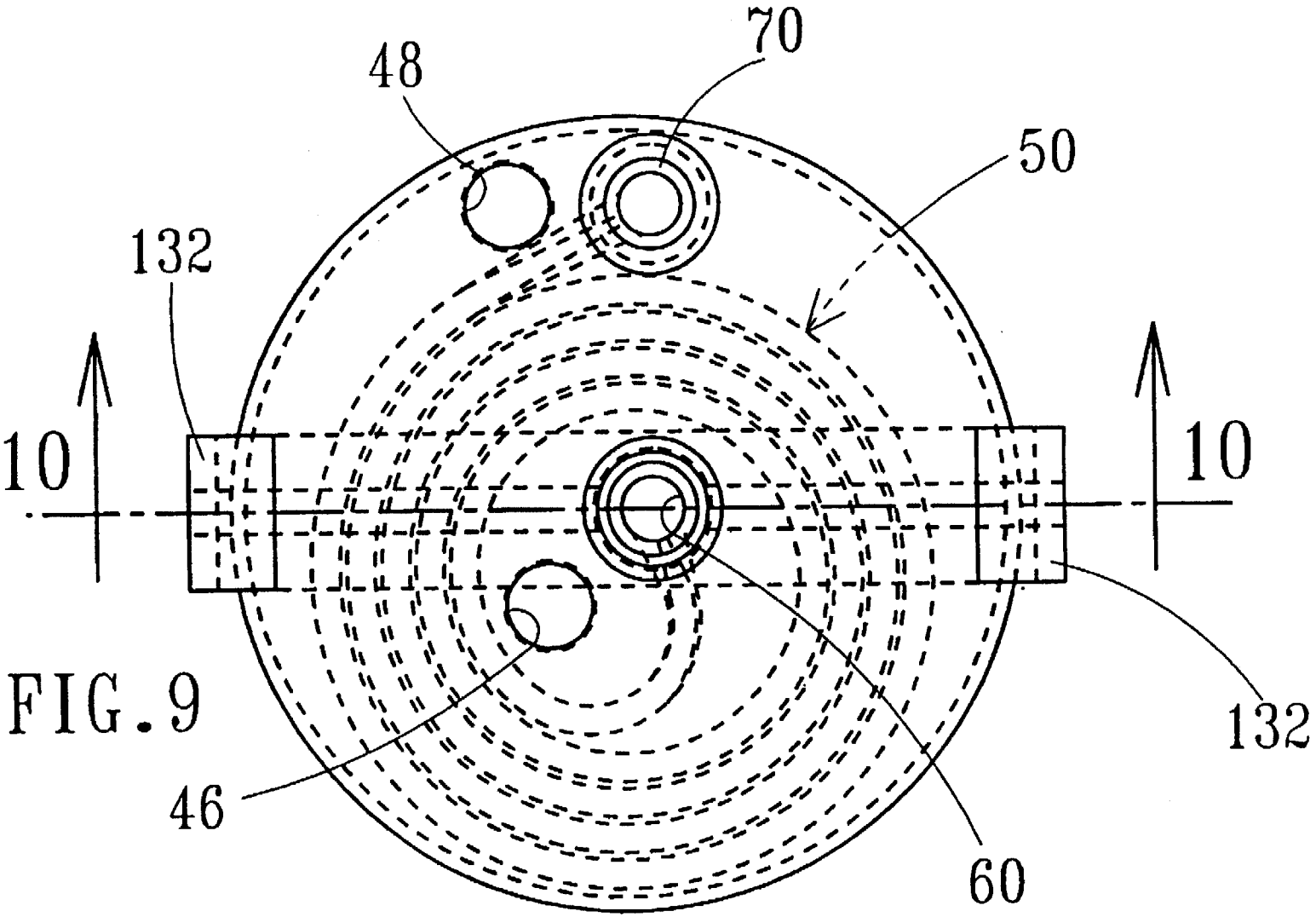
FIG. 9 is a top plan view of a further alternative embodiment of the present invention.
Figure 11:
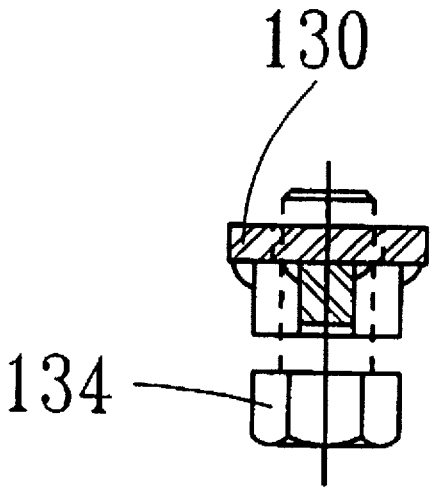
FIG. 11 is a cross sectional view taken along lines 11—11 of FIG. 10.

Another heat exchanger for moving the housing ends relative to each other is shown in FIGS. 9–11. In this third embodiment, a U-shaped clamp 130 having inwardly projecting fingers 132 is employed. The clamp 130 is sized to receive the housing 22 within the arms of the clamp. A bias mechanism 140 is connected to the closed end of the clamp 130 to selectively contact the end wall 30 of the casing. Although shown as a bolt 134 and threaded aperture in the clamp 130, the bias mechanism may be a camming mechanism, or plunger assembly for selectively contacting the housing 22. The clamp 130 operably engages the housing by contacting the fingers 132 against the base plate 26 and the bias mechanism 140 contacts the end wall 30 of the casing to move the housing ends relative to each other. The casing 28 is formed without a casing aperture 31 but may include the casing recess 29. As in the first two embodiments, movement of the housing ends relative to each other is dictated, or limited by contact with the corresponding end of the coil-manifold assembly 50.

ASSEMBLY

To operably assemble the first embodiment of the heat exchanger 20, the respective manifold 60, connector or arm 66 passes through the base plate aperture 41 and the coil-manifold assembly 50 is disposed within the periphery of the base plate 26. The bottom coil 58 contacts the base plate 26. As shown in FIGS. 3, 8 an 10, the simplest connection includes passing all the fluid connections through the base plate 26. A threaded fastener 74 is engaged with the manifold 60, connector or arm 66 which projects through the base plate 26 to draw the bottom coil 58 against the base plate, thereby forming a fluid tight relation therebetween. That is, as the fastener engages the manifold 60, connector or arm 66, and the coil-manifold assembly 50 is pulled against the base plate 26.

Tightening of the fastener 74 allows the bottom coil 58 to be partially deformed or biased against the base plate 26 to preclude fluid flow between the coil-manifold assembly 50 and the base plate. The fastener 74 includes an O-ring 76 retained in an annular seat to contact the base plate 26, manifold 60 and fastener 74 to preclude fluid flow therebetween. The connection of the connector or arm 66 in FIG. 3 also includes a similar sealing and sealing construction.

The casing 28 is then disposed over the upper end of the coil-manifold assembly 50 so that the projecting connector 66, manifold or arm passes through the casing aperture 31. The coil-manifold assembly 50 is further disposed within the casing 28 until the top coil 54 is adjacent to the end wall 30 of the casing 28.

The sealing surface 36 engages the seal 44 of the base plate 26 to form a sliding seal between the housing portions. The sliding seal permits movement of housing portions towards and away from each other while maintaining a seal therebetween. That is, the distance between the ends of the housing 22 that contact the ends of the coil bundle 52 specifically, the end wall 30 and the base plate 26, may be varied to accommodate manufacturing tolerances and fluctuations due to thermal changes while maintaining the contact with the respective end of the coil-manifold assembly 50. Typically, the sliding seal accommodates approximately ¼ inch of relative motion of the housing ends. The sliding seal need only accommodate a sufficient distance of travel to permit each end of the housing 22 to engage the corresponding surface of the coil bundle 52. The sliding seal allows relative movement of the housing ends towards and away from each other, without varying the degree of compression of the seal. That is, in contrast to the prior art which compressed a seal between the base plate and the casing in an amount proportional to the distance between them, the present design renders the compressive force on the seal 44 independent of the distance between the ends of the housing 22. Therefore, the distance between the ends of the housing 22 may be varied without varying the compressive force on the seal 44.

While the components may be configured to exert a compressive force on the seal in relation to the distance between housing ends such as inclining the sealing surface 36 relative to the seal 44, the present design allows the coil bundle 52 rather than the housing 22 set the operable distance between the housing ends. As shown in FIGS. 3, 4 and 6, the casing 28 and base plate 26 are sized so that the annular groove 42 retaining the O-ring 44 is opposed to the sealing surface 36.

A threaded fastener is connected to the projecting portion of the connector 66, manifold or arm extending through the casing aperture 31. The coil-manifold assembly 50 is drawn against the top coil 54 to form a sealed interface between the end wall 30 and the coil-manifold assembly. In the first embodiment, one of the manifolds projects through both the base plate 26 and the end wall 30 to permit each housing component to be separately drawn against the respective surface of the coil bundle 52. Therefore, as shown in FIG. 3, a single fastener operably engages the coil-manifold assembly 50 to the casing 28 so that the casing may be removed by a single fastener.

The portion of the manifold 60, 70, connector or arm 66 extending through the respective aperture permits the corresponding end of the housing 22 to be drawn against the end of the coil bundle 52. That is, the inlet and outlet manifolds 60, 70 may remain on the same end of the coil bundle 52, so long as a connector or arm 66 extends from the other end of the coil bundle to allow fastening to the other end of the housing.

In the second embodiment, the manifold 60 is passed through the base plate 26 and fastener 74 is engaged to draw the bottom coil 58 against the base plate. The bolts passing through the tabs 110 and mating tabs 120 are engaged to draw the end wall 30 against the upper coil 54.

In the third embodiment, the manifold 60 is passed through the base plate 26 and fastener 74 is engaged to draw the lower coil 58 against the base plate 26. The casing 28 is disposed over the coil manifold assembly 50. The clamp 130 is positioned to locate the housing 22 within the arms. The bias mechanism 140 then urges the casing 28 and specifically end wall 30 against the upper coil 54, thereby moving the housing ends relative to each other.

The distance between the periphery of the coils and the side wall 32 is selected to match the distance between adjacent loops of a given coil. That is, the outer loop of the coils do not form a sealed, or flow restrictive interface with the side wall 32, but rather defines a portion of the external flow path.

The present construction does not directly attach or fasten the housing ends to each other, but rather fixedly attaches each housing end to an end of the coil-manifold assembly 50 and the housing ends contact each other at the sliding seal.

The length of travel between the ends of the housing is limited by contact with the ends of the coil-manifold assembly 50. That is, the housing components are sized so that only contact with the coil-manifold assembly 50 limits the travel of the housing ends.

Each end of the housing 22 is thereby drawn against a respective end of the coil-manifold assembly 50 to preclude fluid flow therebetween. Therefore, as the housing 22 fluidly encloses the coil bundle 52, the present construction maintains the external flow path and hence improves the efficiency of the heat exchanger 20.

The interface between the housing portions is defined by the sliding seal rather than the bolt attachment of the prior art. Therefore, the maximum operating pressure of the present design is dictated by the pressure threshold of the sliding seal.

OPERATION

A first flow path passes through the coil-manifold assembly 50. In the first flow path, the fluid enters through the inlet manifold 60 passes through the coils to exit through the outlet manifold 70. A second fluid path is defined by the outside of the coil-manifold assembly 50, the casing 28 and the base plate 26. In the second, external, flow path, fluid is introduced into the heat exchanger through the inlet port 46. The fluid follows the path defined through the inlet port 46 between radially adjacent coil portions to spiral either inward or outward in either a co-current or counter current direction with respect to fluid flow through the coil-manifold assembly 50. The fluid then exits through the outlet port 48.

DISASSEMBLY

To disassemble the first embodiment of the heat exchanger 20 for cleaning and maintenance, the single threaded fastener which engages the connector, manifold or arm passing through the casing 28 is removed thereby permitting the casing, to be separated from the base plate 26 and coil-manifold assembly 50. Preferably, each fluid connection to the heat exchanger 20 is operably connected to the heat exchanger through the base plate 26. Therefore, the casing 28 or remaining component of the housing 22 may be operably connected and removed by a single fastener.

In the second embodiment of FIGS. 7 and 8, the bolts are removed from the tabs 110 and mating tabs 120, thereby permitting separation of the base plate 26 from the casing 28.

In the third embodiment of FIGS. 9–10, the bias mechanism 140 is withdrawn and the clamp 130 removed, thereby permitting separation of the casing 28 and the base plate 26.

The present heat exchanger 20 is described as having one of the inlet and the outlet manifolds 60, 70 passing though the base plate 26, and the inlet and outlet port 46, 48 located in the base plate. However, the invention may be practiced with any combination of the apertures and ports in the base plate 26 and casing 28 as long as each of the housing ends may be independently drawn against the coil-manifold assembly 50 to form a fluid tight relation with the adjacent coil layer, and the interface between the housing components provides a sealing interface which accommodates relative displacement of the housing components.

If complete separation of the coil bundle 52 is required, then the individual couplings of the manifolds to the base plate 26 may be removed.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed:

1. A heat exchanger housing for retaining a coil assembly, the coil assembly having a coil bundle partially defined by a top coil and a bottom coil, and a first manifold and a second manifold fluidly connected to the coil bundle, the housing comprising:

(a) an end wall having an end aperture therein, the end aperture sized to receive a portion of the first manifold therethrough;

(b) a side wall connected to the end wall, the side wall including a sealing surface;

(c) a base plate having a base aperture therein, the base aperture sized to receive a portion of the second manifold therethrough, the end wall, side wall and base plate sized so that a portion of the first manifold extends through the end aperture and a portion of the second manifold extends through the base aperture, the base plate further including a seal surface for cooperating with the sealing surface to form a sliding seal therebetween, the sliding seal configured to permit movement of the base plate in a direction towards and a direction away from the end wall in a sealed relation;

(d) a first fastener for cooperatively engaging the first manifold to secure the coil bundle relative to the end wall and substantially preclude fluid flow between the bottom coil and the end wall; and (e) a second fastener for cooperatively engaging the second manifold to secure the coil bundle relative to the base plate;

the side wall, base plate and end wall sized to allow movement of the base plate towards and away from the end wall to contact the bottom coil with the base plate and the top coil with the end wall, the contact of the bottom coil with the base plate and the top coil with the end wall terminates movement of the base plate towards the end wall substantially independent of contact between the base plate and side wall.

2. A heat exchanger assembly for retaining a coil assembly, the coil assembly having a coil bundle partially defined by an upper surface and a spaced apart lower surface, the heat exchanger assembly, comprising:

(a) a housing for enclosing the coil bundle, the housing having first and second relatively movable ends, one of the first and the second ends including a first aperture therethrough, and a sliding seal between the first and second ends, the sliding seal sized to accommodate movement of the relatively movable ends in a direction towards each other in a sealed relation independent of motion limiting contact between the first and the second relatively movable ends, a sufficient distance to contact the first relatively movable end with the lower surface and the second relatively movable end with the upper surface and substantially preclude fluid flow between the first relatively movable end and the lower surface, and the second relatively movable end and the upper surface; and (b) a first arm attached to the coil bundle and projecting from one of the upper and the lower surface, the first arm sized to pass through the first aperture.

3. The heat exchanger assembly of claim 2, further comprising a first fastener for engaging the first arm to draw the upper surface toward the first end.

4. The heat exchanger assembly of claim 2, wherein the first arm includes a manifold for permitting fluid flow into the coil bundle.

5. A heat exchanger, comprising:

(a) a coil bundle having upper and lower surfaces; and (b) a housing enclosing the coil bundle, the housing having first and second relatively movable ends; and (c) a sliding seal between the first and second ends to permit the ends to be moved together in a sealed relation to engage the upper and lower surfaces of the coil bundle;

the housing, the sliding seal and the coil bundle sized to contact the first movable end with the lower surface and the second movable end with the upper surface to terminate motion of the first and the second end in a direction towards each other, substantially independent of contact between the first and the second relatively movable ends along the direction.

6. The heat exchanger of claim 5, wherein the coil bundle includes a fluid inlet passing through the first end.

7. The heat exchanger of claim 5, wherein the first end includes one of an inlet and an outlet aperture.

8. The heat exchanger of claim 5, further comprising compression means connected to the first and second movable ends for moving the first and second ends relative to each other.

9. The heat exchanger of claim 5, wherein the first end comprises a sleeve and the second end comprises a seal sized to be received within the sleeve.

10. The heat exchanger of claim 6, wherein the fluid inlet includes a first manifold extending through the first end.

11. The heat exchanger of claim 10, wherein the first manifold includes compression means for drawing a portion of the coil bundle against the respective end of the housing.

12. The heat exchanger of claim 10, wherein the compression means includes threads on the first manifold.

13. A heat exchanger housing for retaining a coil bundle, comprising:

(a) an adjustable housing sized to enclose the coil bundle, the adjustable housing having first and second ends moveable in a direction towards and away from each other; and (b) a sliding seal forming a sealed interface between the first and the second ends;

the sliding seal, the first end and the second end sized to selectively vary the distance between the first end and the second end to contact the first end with a lower surface of the coil bundle to substantially preclude fluid flow therebetween and contact the second end with an upper surface of the coil bundle to substantially preclude fluid flow therebetween, the contact of the first and the second ends with the coil bundle terminating movement of the first and second ends towards each other, substantially independent of contact between the first and the second end.

14. The heat exchanger housing of claim 13, wherein the first end includes a first aperture therethrough and the second end includes a second aperture therethrough.

15. The heat exchanger housing of claim 13, further comprising:

(a) a first single fastener for operatively contacting the first end to the upper surface of the coil bundle; and (b) a second single fastener for operatively contacting the second end to the lower surface of the coil bundle.

16. The heat exchanger housing of claim 13, further comprising:

(a) means for contacting one end of the housing with the upper surface and the remaining end of the housing with the lower surface.

17. The heat exchanger housing of claim 16, wherein the means for contacting includes a clamp.

* * * * *